United States Patent [19]

Luxton et al.

[11] Patent Number: 5,060,867

[45] Date of Patent: Oct. 29, 1991

[54] CONTROLLING THE MOTION OF A FLUID JET

[75] Inventors: Russell E. Luxton, Adelaide; Graham J. Nathan, Happy Valley, both of Australia

[73] Assignee: Luminis Pty. Ltd., Australia

[21] Appl. No.: 442,363

[22] PCT Filed: Apr. 15, 1988

[86] PCT No.: PCT/AU88/00114

§ 371 Date: Dec. 15, 1989

§ 102(e) Date: Dec. 15, 1989

[87] PCT Pub. No.: WO88/08104

PCT Pub. Date: Oct. 20, 1988

[30] Foreign Application Priority Data

Apr. 16, 1987 [AU] Australia ..... PI 1476
Aug. 31, 1987 [AU] Australia ..... PI 4068

[51] Int. Cl.[5] ..... F23D 14/62; F23D 14/48; F23D 14/04; B01F 3/02

[52] U.S. Cl. ..... 239/428.5; 239/589; 431/9

[58] Field of Search ..... 239/428.5, 590, 590.3, 239/590.5, 589; 431/9, 115, 116, 252

[56] References Cited

U.S. PATENT DOCUMENTS 2,098,455 11/1937 Lattner ..... 239/434.5
3,876,362 4/1975 Hirose ..... 431/9
3,954,382 5/1976 Hirose ..... 431/9
4,127,332 11/1978 Thiruvengadam et al. ..... 366/131

FOREIGN PATENT DOCUMENTS 0056508 7/1982 European Pat. Off. .
01322847 2/1985 European Pat. Off. .
1937798 2/1971 Fed. Rep. of Germany .
2948559 6/1981 Fed. Rep. of Germany .

OTHER PUBLICATIONS

"Fluid Amplifiers" by Joseph M. Kirshner, pp. 118-125, McGraw-Hill Book Co. ©1966.

*Primary Examiner*—Andres Kashnikow
*Assistant Examiner*—Karen B. Merritt
*Attorney, Agent, or Firm*—Sughrue, Mion, Zinn Macpeak & Seas

[57] ABSTRACT

A fluid mixing device has a chamber with a fluid inlet and an opposite fluid outlet. The device causes a flow of a first fluid wholly occupying the inlet to separate from the chamber wall upstream of the outlet. The distance between the flow separation and the outlet is sufficiently long in relation to the width of the chamber for the separated flow to reattach itself asymmetrically to the chamber wall upstream of the outlet and to exit the chamber through the outlet asymmetrically. A reverse flow of the first fluid at the reattachment and/or a flow of a second fluid induced through the outlet thereby swirls in the chamber between the flow separation and the reattachment and induces precession of the separated/reattached flow. This precession enhances mixing of the flow with the second fluid from the exterior of the chamber.

21 Claims, 9 Drawing Sheets

CONTROLLING THE MOTION OF A FLUID JET

TECHNICAL FIELD

This invention relates generally to the control of the motion of a gaseous, liquid or mixed-phase fluid jet emanating from a nozzle. The invention is concerned in particular aspects with enhancing or controlling the rate of mixing of the jet with its surroundings, and in other aspects with controlling the direction in which the jet leaves its forming nozzle. A particularly useful application of the invention is to mixing nozzles, burners or combustors which burn gaseous, liquid or particulate solid fuels, where it is necessary for a fuel-rich stream of fluid or particles to be mixed as efficiently as possible with an oxidizing fluid prior to combustion. The invention is however directed generally to mixing of fluids and is not confined to applications which involve a combustion process.

In a particular configuration the invention allows control of the vector direction in which a jet exits a nozzle, and hence may be used to control the direction of the thrust force exerted on the body from which the jet emanates. The feature may also be employed to direct a jet in a particular direction for any other purpose.

BACKGROUND ART

Heat energy can be derived from "renewable" natural sources and from non-renewable fuels. Currently the most usual fuels used in industry and for electricity generation are coal, oil, natural and manufactured gas. The convenience of oil and natural gas will ensure they remain preferred fuels until limitations on their availability, locally or globally, cause their prices to rise to uneconomic levels. Reserves of coal are very much greater and it is likely that coal will meet a substantial portion of energy needs, especially for electricity generation, well into the future. The burning of pulverised coal in nozzle-type burners is presently the preferred method of combustion in furnaces and boiler installations. It is predicted that this preference will continue for all but the lowest grades of coal, for which grades fluidised beds, oil/coal slurries or some form of pretreatment may be preferred.

Gasification of the coal is a recognised form of pretreatment. The viability of using lower grade coals, via a gasification process, as an energy source for power generation and heating could be increased if an inherently stable gas burner, which is tolerant of wide variations in the quality of the gas supplied to it, could be developed.

One usual constraint in the design and operation of prior combustion nozzles for gaseous fuels is that the mass flow rate of the fuel through a nozzle of given size is restricted by the rate at which the nozzle jet velocity decays through mixing to that of the flame propagation velocity in the mixture. For a flame to exist this condition must occur at a mixture strength within the combustible range for the particular fuel and oxidant. If the flow rate through the nozzle is high, such that the condition occurs far from the exit plane of the nozzle where the intensity and scale of the turbulent velocity fluctuations are both large, the flame front may fluctuate beyond the lean limit for combustion of the mixture resulting in extinction of the flame. Hence, if the spreading rate and mixing of the fluid jet emanating from the nozzle can be greatly enhanced, the flame front will be more stable and will be positioned closer to the nozzle. In a similar manner, improvements in the mixing process for the combustion of particulate fuel (for example, pulverised coal) which is entrained in a gas stream can lead to more effective control over the particle residence times required for drying, preheating, release of volatiles, combustion of the particles and the control of undesirable emission products such as oxides of sulphur and nitrogen.

Swirl burners, bluff-body flow expanders or flameholders and so-called slot-burners are among the devices which have been used to enhance mixing of the fuel jet with its surroundings to overcome, or delay, the type of combustion instability described in the preceding paragraph, at the cost of increased pressure loss through the mixing nozzle and/or secondary airflow system. Such nozzles are constrained to operate below a critical jet momentum at which the stabilising flow structures they generate change suddenly, losing their stabilising qualities, and causing the flame to become unstable and eventually to be extinguished.

All of the above-mentioned means of improving flame stability are usually combined with partial "premixing" of the fuel with air or oxidant. Such pre-mixing has the effect of reducing the amount of mixing required between the fuel jet and its oxidising surroundings to produce a combustible mixture.

If incorrectly designed or adjusted, a pre-mixed burner can allow "flash-back", a condition in which the flame travels upstream from the burner nozzle. In sever cases where normal safety procedures have failed or been ignored, this can lead to an explosion.

Another means of producing a stable flame at increased fuel flow rates is by pulsating the flow of fluid or by acoustically exciting the nozzle jet to increase mixing rates. Excitation may be by means of one or more pistons, by a shutter, by one or more rotating slotted discs or by means of a loud speaker or vibrating vane or diaphragm positioned upstream of, at, or downstream from, the jet exit. When a loud speaker is used, the phase and frequency of the sound may be set by a feed-back circuit from a sensor placed at the jet exit. Under certain conditions, the jet can be expanded and mixed very rapidly through the action of intense vortices at the jet exit. It is also possible to cause the jet to excite itself acoustically, without requiring any electronic circuits or the like, by causing naturally occurring flow fluctuations to excite a cavity to acoustic resonance. Some advantage has been claimed for a cavity at the nozzle exit at specific jet flow velocities. By positioning the resonant cavity between an inlet and an outlet section within the jet nozzle, enhanced mixing occurs over a wider range of jet flow velocities. This is the principle of the so-called "whistle" burner which has been described in the specification of Australian patent application No. 88999/82.

One severe limitation of the whistle burner is that enhancement only occurs at the high end of the operating range of the burner as the excitation requires a high exit speed of the fuel jet from the nozzle. The driving pressure required to achieve this high exit speed is larger than that normally available in industrial gas supplies.

A further disadvantage of the whistle burner is the high level of noise produced at a discrete frequency.

As mentioned, the invention also relates in certain aspects to controlling the direction in which the jet leaves its forming nozzle. The design and manufacture of jet nozzles which direct the jet in a particular direction by moving the nozzle itself, or by means of deflector vanes or tabs inserted into the jet to deflect it as it leaves the nozzle, is complex and there is potential for failure or error in the operation of such "vectored jet" nozzles. These nozzles are employed, for example, in short take-off and landing aircraft, for missile decoy devices, in space-craft for attitude control and in some fluidic control devices.

SUMMARY OF THE INVENTION

An object of the invention in one or more of its aspects is to provide a fluid mixing device which may be utilized as a combustion nozzle to at least in part alleviate the aforementioned disadvantages of combustion nozzles currently in use.

A particular object for a preferred embodiment of the invention is to provide enhanced mixing between a fluid jet and its surroundings, of magnitude similar to that achieved with a "whistle" burner but at much lower fuel jet exit speeds, at much lower driving pressures and without generating high intensity noise at a discrete frequency.

A further particular object for another preferred embodiment of the invention is to provide a jet nozzle in which the direction of the jet is controllable.

The invention accordingly provides, in a first aspect, a fluid mixing device comprising:

wall structure defining a chamber having a fluid inlet and a fluid outlet disposed generally opposite the inlet;

said chamber being larger in cross-section than said inlet at least for a portion of the space between said inlet and outlet;

flow separation means to cause a flow of a first fluid wholly occupying said inlet to separate from said wall structure upstream of the outlet;

wherein the distance between said flow separation means and said outlet is sufficiently long in relation to the width of the chamber for the separated flow to reattach itself asymmetrically to the chamber wall structure upstream of the outlet and to exit the chamber through the outlet asymmetrically, whereby a reverse flow of said first fluid at said reattachment and/or a flow of a second fluid induced from the exterior of the chamber through said outlet swirls in the chamber between said flow separation and said reattachment and thereby induces precession of said separated/reattached flow, which precession enhances mixing of the flow with said second fluid to the exterior of the chamber.

The invention further provides, in a second aspect, a method of mixing first and second fluids, comprising:

admitting the first fluid into a chamber as a flow which separates from the chamber wall structure; and allowing the separated flow to reattach itself asymetrically to the chamber wall structure upstream of an outlet of the chamber disposed generally opposite the admitted flow, and to exit the chamber through the outlet asymmetrically, whereby a reverse flow of the first fluid at said reattachment and/or a flow of the second fluid induced from the exterior of the chamber through said outlet combine to swirl in the chamber between said flow separation and said reattachment and thereby induce precession of said separated/reattached flow, which precession enhances mixing of this flow with the second fluid to the exterior of the chamber.

In a third aspect, the invention still further provides combustion apparatus which incorporates a combustion nozzle comprising a fluid mixing device according to the first aspect of the invention. The first fluid may be a gaseous fuel and the second fluid air or oxygen about the nozzle. In a combustor or in the mixing of dissimilar fluids, the roles of the two fluids may be interchanged if such interchange is advantageous.

The device is preferably substantially axially symmetrical, although non-asymmetrical embodiments are possible. When the device is axi-symmetric, the asymmetry of the reattachment of the primary jet inside the chamber results from the minor azimuthal variations, which occur naturally, in the rate of entrainment of surrounding fluid from within the confined space of the chamber. This situation is inherently unstable so that the rate of deflection of the primary jet increases progressively until it attaches to the inside wall of the chamber.

The outlet is advantageously larger than the inlet, or at least larger than the chamber cross-section at the said separation of the flow. This ensures a sufficient cross-section to contain both the asymmetrically exiting precessing flow and the induced flow. The outlet may be simply an open end of a chamber or chamber portion of uniform cross-section but it is preferable that there be at least some peripheral restriction at the outlet to induce or augment a transverse component of velocity in the reattached precessing flow. The fluid inlet is most preferably a contiguous single opening which does not divide up the first fluid as it enters the chamber.

The term "precession" as being employed herein refers simply to the revolving of the obliquely directed asymmetric flow about the axis joining the inlet and outlet. It does not necessarily indicate or imply any swirling within the flow itself as the flow revolves, though this may of course occur.

The invention further broadly provides a method of mixing two fluids, comprising deflecting or allowing deflection of a flow of one of the fluids through an acute angle and causing the deflected flow to precess, and preferably also diverge, which precession enhances mixing of the flow with the other of the fluids to the exterior of the chamber.

The first and second aspects of the invention are embraced by this broad invention but in those cases the precession of the flow is caused by the geometry of the device itself.

Instead of substantially complete separation of the flow, and induced precession of the exiting, asymmetrically directed fluid, the separation may be partial only, e.g. on one side of the inlet and axis, and the resultant partially separated flow a directed flow at an angle to the axis towards the same side of the chamber as that at which separation occurred.

The invention accordingly provides, in a fourth aspect, a fluid flow control device, comprising:

wall structure defining a chamber having a fluid inlet and a fluid outlet disposed generally opposite the inlet;

said chamber being larger in cross-section than said inlet at least for a portion of the space between said inlet and outlet;

flow separation means to cause a flow of a first fluid wholly occupying said inlet to partially separate from said wall structure upstream of the outlet;

wherein the distance between the flow separation means and said outlet is sufficiently long in relation to the width of the chamber for the partially separated flow to induce a second flow from the exterior of the chamber through said outlet and for this second flow to influence the partially separated flow whereby the latter exits the chamber asymmetrically in a direction toward the same side of the chamber as the flow separation.

In this case, it is most preferable that the outlet includes a peripheral restriction such as a surrounding lip to act on the flow and enhance its asymmetric direction from the outlet. The inlet is preferably a smoothly convergent-divergent restriction fitted with a protuberance or other distrubance, at one side at or near its minimum cross-section, to cause said partial separation. The protuberance is advantageously withdrawable and may be relatively circumferentially moveable to permit control of the direction of the exiting flow. Alternatively, multiple elements are individually provided with means to retract or to project them into the interior of the restriction at different azimuthal or circumferential locations. The protuberance may be a tab or other material device or it may be a small jet of similar or dissimilar fluid to that of the primary jet.

In a nozzle according to this embodiment of the invention, the attached flow through the chamber is suddenly deflected at exit from the chamber, by a combination of the lip at the exit plane and asymmetric entrainment of the fluid induced from the exterior, to leave the nozzle as a jet moving in a direction opposite from the side of the chamber to which the flow had remained attached. This asymmetrically directed jet does not precess about the nozzle but remains in a fixed angular location relative to the protuberance or disturbance at the inlet plane. Thus the vector direction of the jet may be fixed by means of the small protuberance or disturbance inserted or injected at or near the throat, that is at or near the minimum section, of the inlet to the nozzle. The direction may be varied by varying the azimuthal position of the protuberance. This may be achieved by rotating the whole nozzle about its major axis or by arranging a number of actuators around the inlet nozzle throat each able to be inserted into the flow, or withdrawn from the flow, be they pin, rod or local fluid jet, to form or remove a protuberance at a particular azimuthal location. Such actuators could be manually, mechanically or electro-magnetically operated and could be controlled by a computer or other logic control system.

When a mixing nozzle according to the first aspect of the invention is embodied as a burner jet for the combustion of gaseous fuel, the mixing, and hence the flame stability, are enhanced over the whole range of operation from a pilot flame through to many times the driving pressure required to produce sonic flow through the smallest aperture within the burner.

Thus, for normal operation a jet nozzle embodying the invention can produce a flame of improved stability at operating pressures and flows typical of prior combustion nozzles. For special applications requiring very high intensity combustion it also produces a stable flame up to and beyond the pressures required to cause sonic ("choked") flow within the nozzle.

It is important to note that the above superior level of stability is achieved without the need to pre-mix the fuel and oxidant. However, if a limited amount of pre-mixing is employed the enhanced mixing between the premixed jet and its surroundings again improves the flame stability.

The jet mixing nozzle embodying the invention may be combined with other combustion devices such as swirling of the secondary air, an inlet quarl and, for some applications, a "combustion tile" forming a chamber and contraction to produce a high momentum flame.

Because the jet mixing nozzle can be operated at low jet velocities and is not dependent on the acoustic properties of the flow through it, it can be applied to the combustion of pulverised solid fuels, atomised liquid fuels or fuel slurries.

In some applications and embodiments the enhancement of the mixing may exhibit occasional intermittency, especially in very small nozzles. Such intermittency may be eliminated by the placement of a small bluff body or hollow cylinder within the chamber or just outside the chamber outlet. Alternatively the flow entering the chamber may be induced to swirl slightly by pre-swirl vanes, or by other means, to reduce or eliminate the intermittency as required.

The ratio of the distance between the flow separation means and the outlet to diameter of the chamber at the reattachment locus is preferably greater than 1.8, more preferably greater than or equal to 2.0, and most preferably about 2.7. Where the chamber is a cylinder of uniform cross-section extending between orthogonal end walls containing said inlet and outlet, this ratio is that of the chamber length to its diameter.

DETAILED DESCRIPTION OF THE ILLUSTRATED EMBODIMENTS

Figure 1A:
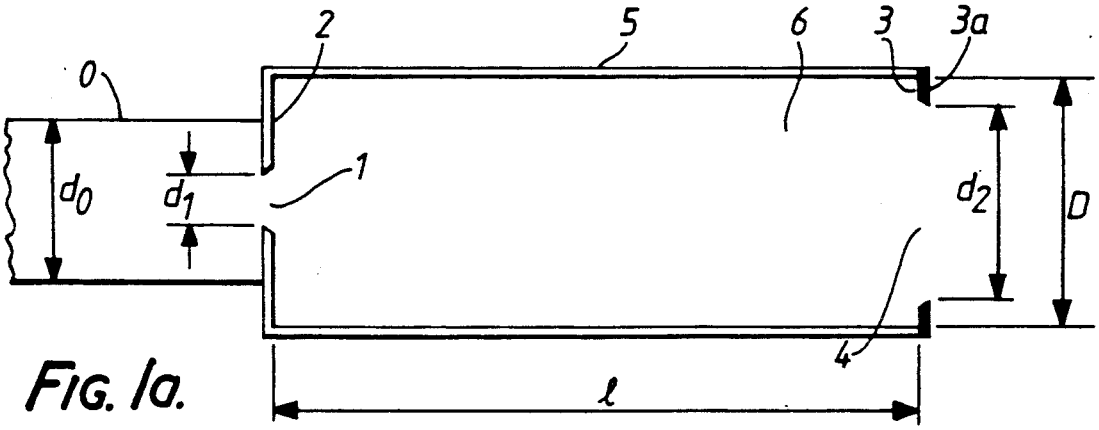
FIGS. 1 (*a–h*) illustrate a selection of altenative embodiments of mixing nozzle constructed in accordance with the present invention, suitable for mixing a flow with the fluid surrounds of the nozzle.
Figure 1B:
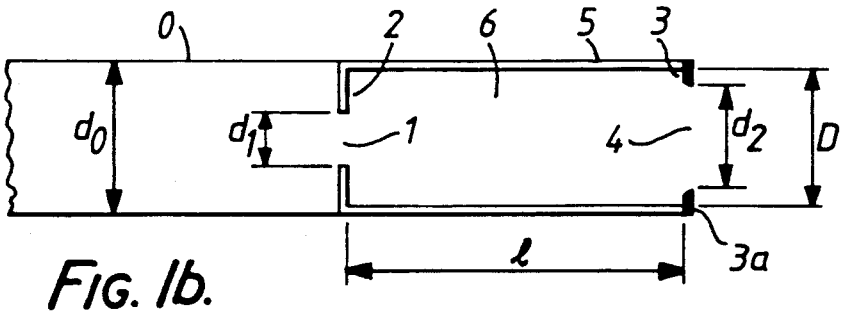
Figure 1C:
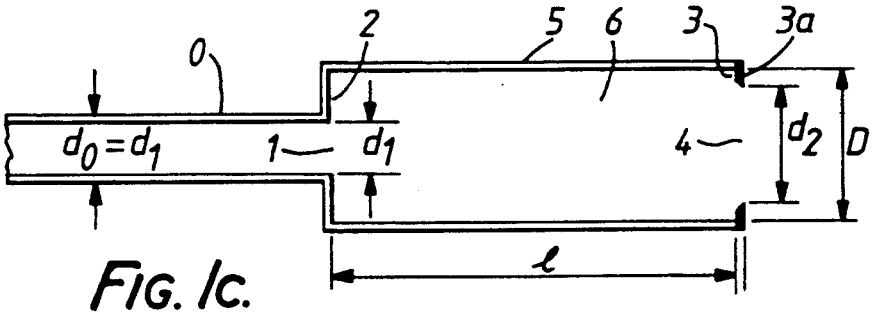
Figure 1D:
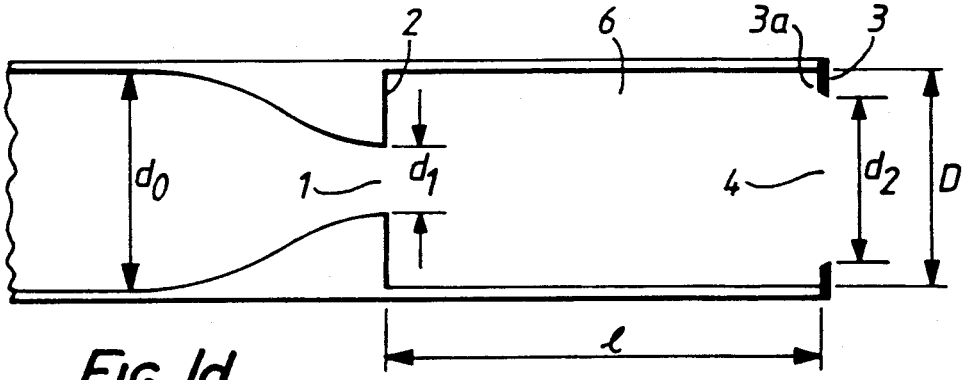

In the embodiments of the present invention illustrated in FIGS. 1(*a–e*), the nozzle comprises a conduit (5) containing a chamber (6). The chamber (6) is defined by the inner cylindrical face of the conduit (5), by orthogonal end walls defining an inlet plane (2), and an exit plane (3). Inlet plane (2) contains an inlet orifice (1)

of diameter $d_1$ the periphery of which thereby serves as means to separate a flow through the inlet orifice (1) from the walls of the chamber. Exit plane (3) essentially comprises a narrow rim or lip (3a) defining an outlet orifice (4) of diameter $d_2$ somewhat greater than $d_1$. Rim or lip (3a) may be tapered as shown at its inner margin, as may be the periphery of the inlet orifice (1). Fluid is delivered to orifice (1) via a supply pipe (o) of diameter $d_o$.

All five embodiments illustrated in FIGS. 1(a–e) consist of a substantially tubular chamber of length l and diameter D (wherein diameter D is greater than the inlet flow section diameter $d_1$). The chamber need not be of constant diameter along its length in the direction of the flow. Preferably, a discontinuity or other relatively rapid change of cross-section occurs at the inlet plane (2) such that the inlet throat diameter is $d_1$. The relationship between the diameter of the upstream conduit $d_o$ and the inlet diameter $d_1$ is arbitrary but $d_o \geqq d_1$.

Typical ratios of dimensions l to D lie in the range $2.0 \leqq l/D \leqq 5.0$.

A ratio of $l/D \simeq 2.7$ has been found to give particularly good enhancement of the mixing.

Typical ratios of dimensions $d_1$ to D lie in the range $0.15 \leqq d_1/D \leqq 0.3$.

Typical ratios of dimensions $d_2$ to D lie in the range $0.75 \leqq d_2/D \leqq 0.95$.

Figure 5:
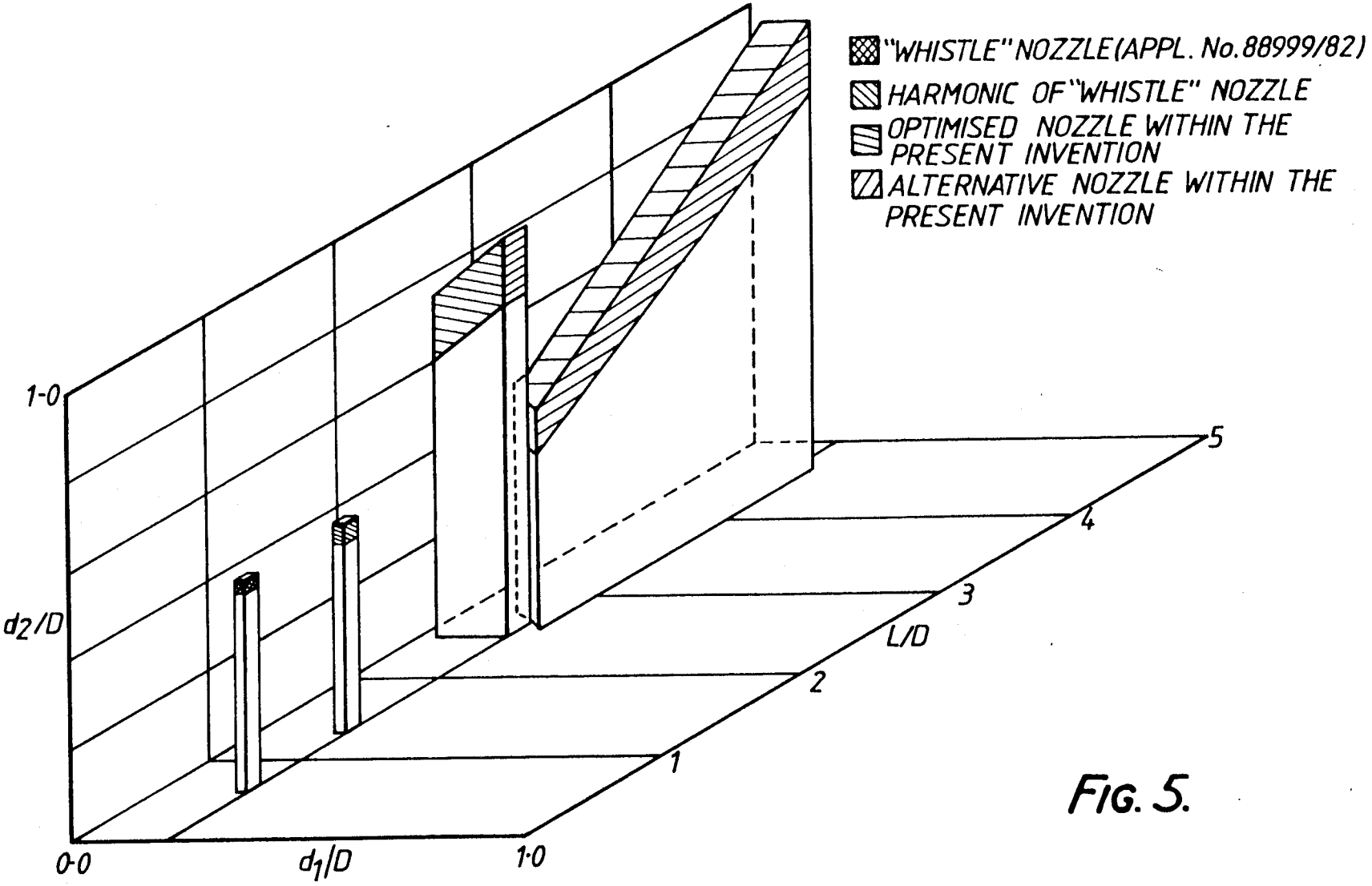
FIG. 5 depicts, for two different nozzles according to the present invention and for the prior "whistling" nozzle, the geometric ratios required to achieve stable combustion nozzles.

These ratios are typical for the embodiments illustrated in FIG. 1(a–e) but are not exclusive and are not necessarily those applicable for all embodiments. The relationship of the geometric ratios of the present invention, as given above, to those of prior art nozzles is illustrated in FIG. 5. It should be noted that the range of geometric ratios for which mixing enhancement is consistently stable is increased substantially by means of the embodiment illustrated in FIG. 1(e).

Figure 1E:
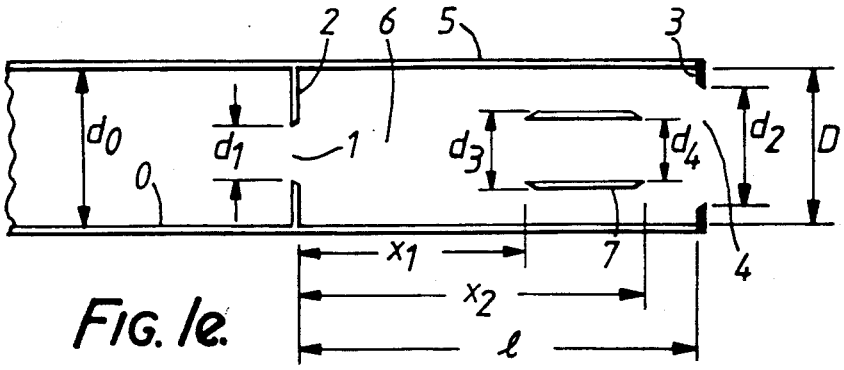

In FIG. 1(e) is indicated a body (7) suitably suspended in the flow for the aforementioned purpose of preventing intermittency, i.e. reversals of the direction of precession. The body may be solid or it may be hollow. It may also be vented from its inside surface to its outside surface. Body (7) may have any upstream and downstream shape found to be convenient and effective for a given application. For instance, it may be bullet shaped or spherical. It may further provide the injection point for liquid or particulate fuels. The length of the body $(x_2 - x_1)$ is arbitrary but is usually less than half the length l of the cavity when the body is hollow; and is typically less than D/4 when the body is solid. It is typically placed within the cavity as illustrated in FIG. 1(e), in which case both $x_2 < l$ and $x_1 < l$; it may also be placed spanning the exit plane (3), in which case $x_2 > l$ and $x_1 < l$; or it may be wholly outside the exit plane (3) of the nozzle, in which case $x_2 > l$ and $x_1 > l$. The outside diameter $d_3$ of the body is less than the cavity diameter D and the inside diameter $d_4$ may take any value from zero (solid body) up to a limit which approaches $d_3$. The body is typically placed symmetrically relative to the conduit but it may be placed asymmetrically.

Figure 1F:
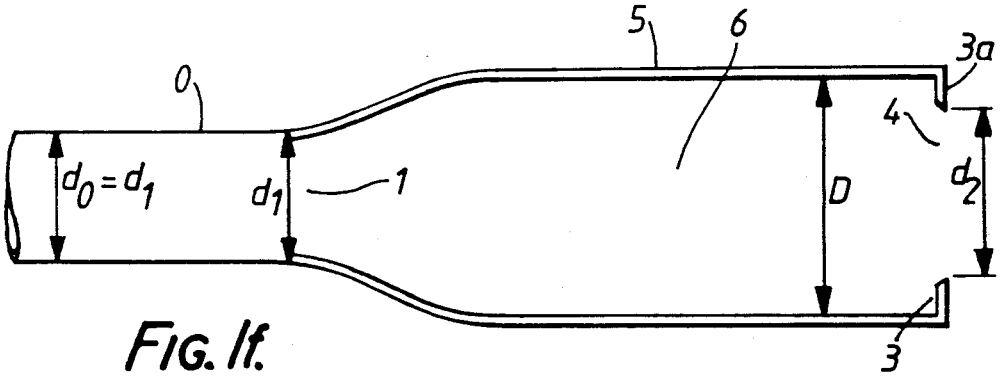
Figure 1G:
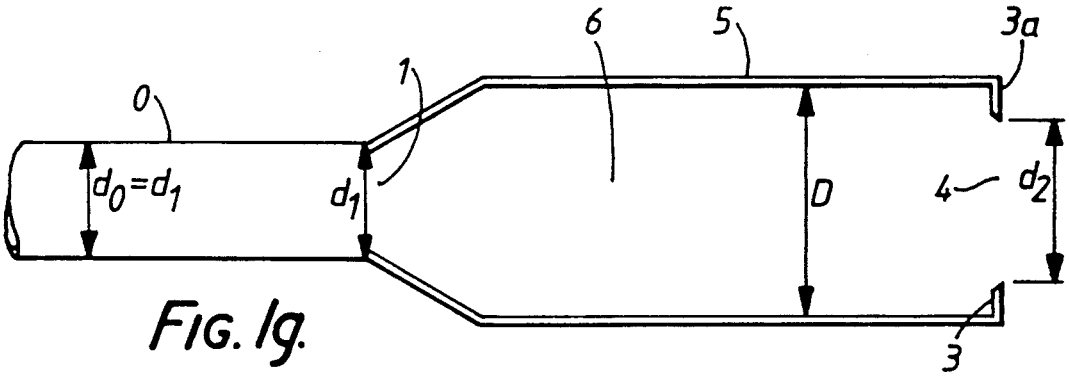
Figure 1H:
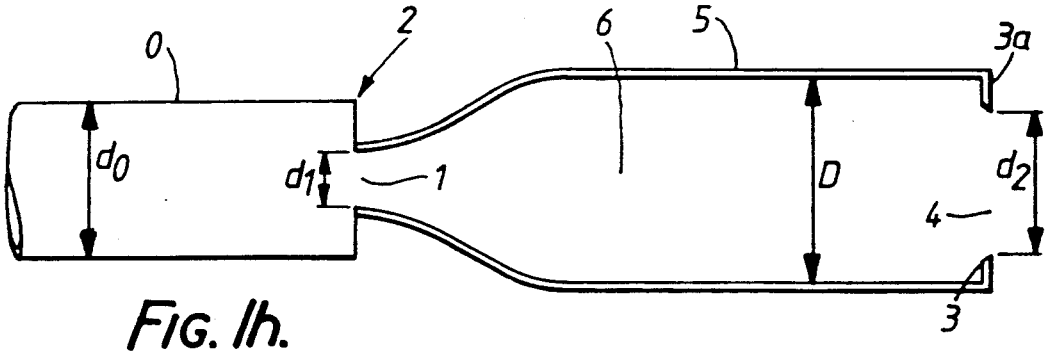

The embodiments of FIG. 1(f), (g) and (h) differ in that the chamber (6) diverges gradually from inlet orifice (1). In this case, the angle of divergence and/or the rate of increase of the angle of divergence must be sufficient to cause full or partial separation of flow admitted through and fully occupying the inlet orifice (1) for precession of the jet to occur.

FIGS. 2(a–e) illustrate typical geometries for the mixing of two fluid streams, one inner and the other outer designated by FLOW 1 or FLOW 2 respectively. Either FLOW 1 or FLOW 2 may represent e.g. a fuel, and either or both FLOW 1 and/or FLOW 2 may contain particulate material or droplets. In the case of FIG. 2(a), FLOW 1 may be introduced in such a manner as to induce a swirl, the direction of which is preferably, but not necessarily, opposed to that of the jet precession alternatively FLOW 1 may be unswirled. The relationship between diameters D and d may take any physically possible value consistent with the achievement of the required mixture ratio between the streams. The expansion (8) is a quarl the shape and angle of which may be chosen appropriately for each application.

Figure 2A:
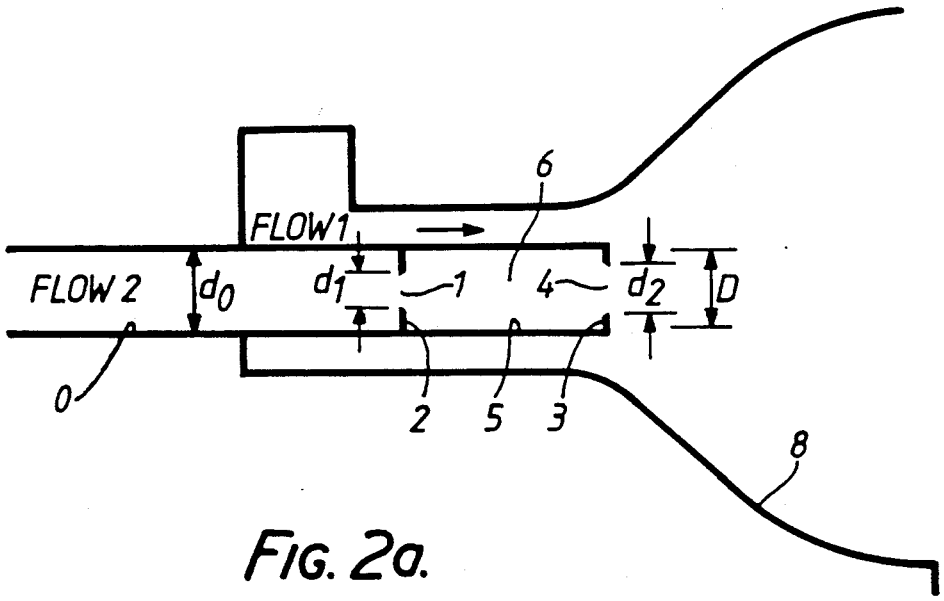
FIGS. 2 (*a–e*) illustrate a selection of applications of mixing nozzle according to the invention, where the mixing of two flows is required.
Figure 2B:
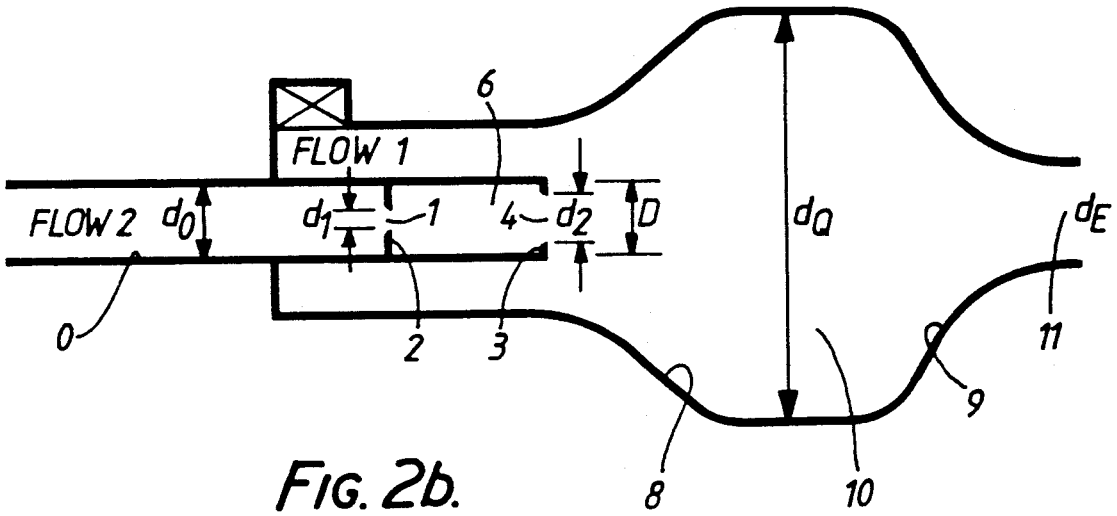
Figure 2C:
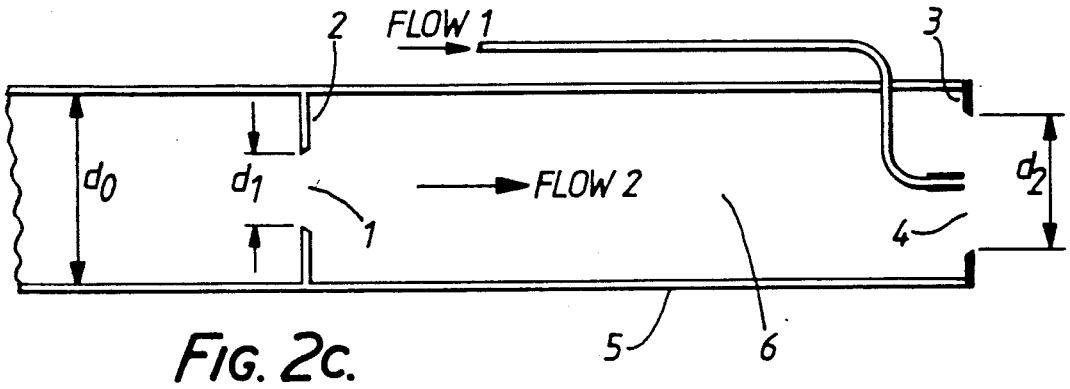
Figure 2D:
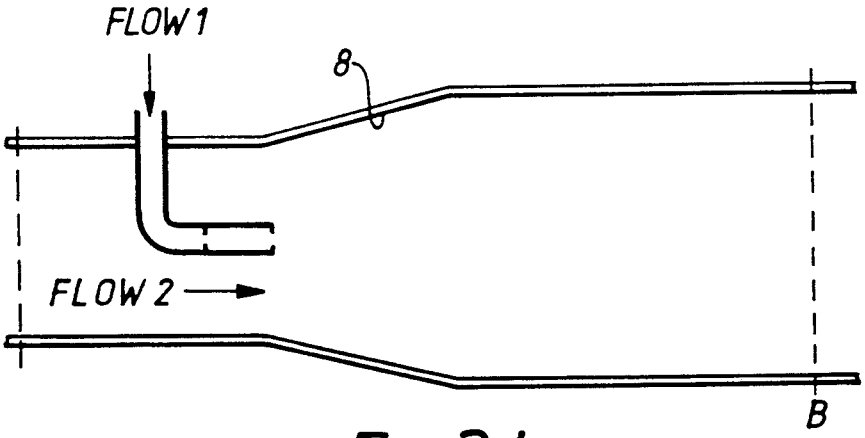
Figure 2E:
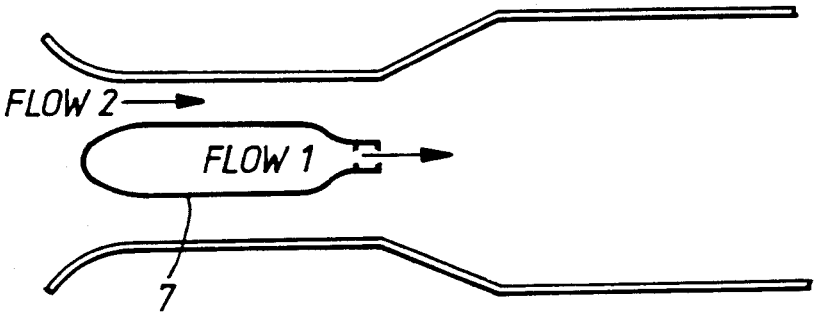

FIG. 2(b) depicts a variation of FIG. 2(a) in which a chamber (10) has been formed by the addition of a combustion tile (9) through which the burning mixture of fuel and oxidant is contracted from the quarl diameter $d_Q$ to form a burning jet from an exit (11) of diameter $d_E$ or from an exit slot (11) of height $d_E$ and whatever width may be convenient. In this configuration, by suitable choice of the shape and expansion angle of the quarl (8) relative to the swirl of FLOW 1 and the precession rate of FLOW 2, a vortex burst may be caused to produce fine-scale mixing between the fluids forming FLOW 1 and FLOW 2, in addition to the large-scale mixing which is generated by the precession of the jet.

A nozzle according to the present invention is preferably constructed of metal. Other materials can be used, either being moulded, cast or fabricated, and the nozzle could be made, for example, of a suitable ceramic material. Where a combustion tile is employed, both the tile and the quarl should ideally be made of a ceramic or other heat resisting material. For non-combustion applications in which temperature are relatively low, plastic, glass or organic materials such as timber may be used to construct the nozzle.

The nozzles of the present invention are preferably circular in cross-section, but may be of other shapes such as square, hexagonal, octagonal, elliptical or the like. If the cross-section of the cavity has sharp corners or edges some advantage may be gained by rounding them. As described hereinbefore, there may be one or more fluid streams, and any fluid stream may carry particulate matter. The flow speed through the inlet orifice (1) of diameter $d_1$ may be subsonic or, if a sufficient pressure ratio exists across the nozzle, may be sonic. That is, it may achieve a speed equal to the speed of sound in the particular fluid forming the flow through orifice (1). Other than in exceptional circumstances in which the supply pipe (o) is heated sufficiently to cause the flow to become supersonic, the maximum speed through orifice (1) will be the speed of sound in the fluid. In most combustion applications the speed is likely to be sub-sonic. In some applications, it may be appropriate to follow the throat section $d_1$ with a profiled section designed to produce supersonic flow into the chamber.

From a combination of careful visualisation of the flow within and beyond the mixing nozzle according to the invention, (by means of high and low speed cinematography of dye traces in water, of smoke patterns in air, of particle motions and of the migrations of oil films on the inner surfaces of the nozzle), and measurements of mean and fluctuating velocities in the system, the following sequence appears to describe the flow. This detailed description is not to be construed as limiting on the scope of the invention, as it is a postulate based on analysis of observed effects. The sequence is described with reference to FIG. 6.

Beginning with unswirled (parallel) flow in the upstream inlet pipe (o), the fluid discharges into the chamber (6) through inlet orifice (1), where the flow separates as a jet (20). The geometry of the nozzle is selected so that naturally occurring flow instabilities will cause the flow (20) (which is gradually diverging as it entrains fluid from within the cavity (21)) to reattach asymmetrically at (22) to part of the inner surface of the chamber (6). The majority of the flow continues in a generally downstream direction until it meets the lip or discontinuity (3*a*) about the outlet orifice (4) in the exit plane (3) of the nozzle. The lip induces a component of the flow velocity directed towards the geometric centreline of the nozzle, causing or assisting the main diverging flow or jet to exit the nozzle asymmetrically at (23). The static pressure within the chamber and at the exit plane of the nozzle is less than that in the surroundings, due to the entrainment by the primary jet within the chamber, and this pressure difference across the exiting jet augments its deflection towards and across the geometric centreline. As the main flow does not occupy the whole of the available area of the outlet orifice of the nozzle, a flow (24) from the surroundings is induced to enter into the chamber (6), moving in the upstream direction, through that part of the outlet orifice not occupied by the main flow (20).

That part (26) of the reattaching flow within the chamber which reverses direction takes a path which is initially approximately axial along the inside surface of the chamber (6) but which begins to slew and to be directed increasingly in the azimuthal direction. This in turn causes the induced flow (24) to develop a swirl which amplifies greatly as the inlet end of the chamber is approached. Flow streamlines in this region are almost wholly in the azimuthal direction as indicated by the broken lines (25) in FIG. 6. It is thought that the fluid then spirals into the centre of the chamber, being re-entrained into the main flow (20). The pressure field driving the strong swirl within the chamber between the points of separation (1) and reattachment (22) applies an equal and opposite rotational force on the main flow (20), tending to make it precess about the inside periphery of the chamber. This precession is in the opposite direction from that of the fluid swirl (25) within the chamber and produces a rotation of the pressure field within the chamber. The steady state condition is thus one of dynamic instability in which the (streamwise) angular momentum associated with the precession of the primary jet and its point of reattachment (22) within the chamber (6), is equal and opposite to that of the swirling motion of the remainder of the fluid within the chamber. This is because there is no angular momentum in the inlet flow, and no externally applied tangential force exerted on the flow within the chamber; thus the total angular momentum must be zero at all times.

The main flow, on leaving the nozzle, is, as already noted, directed asymmetrically relative to the centre line of the nozzle and precesses rapidly around the exit plane. There is then, on average, a very marked initial expansion of the flow from the nozzle. Note that as the main flow precesses around the exit plane, so too does the induced flow (24) from the surroundings as it enters the chamber. This external fluid is entrained into the main flow within the chamber, so initiating the mixing process. A consequence of the observations of the previous paragraph concerning angular momentum is that because the main flow is precessing as it leaves the nozzle, the fluid within the jet must be swirling in the direction opposite to the direction of precession in order to balance the angular momentum.

There is no necessarily preferred direction for the swirl which is initiated within the chamber. Once initiated it tends to maintain the same swirl direction, and the opposing precession direction, for considerable periods. However, on occasion, the directions may, for some reason which is not yet understood, change. When this occurs there is a momentary change in the degree of mixing enhancement. The frequency of such changes in the swirl and precession directions appears to increase as the size of the nozzle decreases. Thus the incidence with which the degree of enhancement changes is greater for small nozzles than for large nozzles. This is the "intermittency" referred to earlier. It can be eliminated by introducing into the chamber, or immediately beyond the outlet from the chamber, some minor obstacle such as the body 7 in FIG. 1(*e*), or a solid body as previously described, or by prescribing a preferred direction of swirl by means of a swirl producing device in the feed pipe (o) to the nozzle. The resulting precession is then stable and in the direction opposite from that of the swirl. The total angular momentum at any time must then equal that introduced into the flow by the swirl producing device in the feed pipe (0) to the nozzle.

Figure 6:
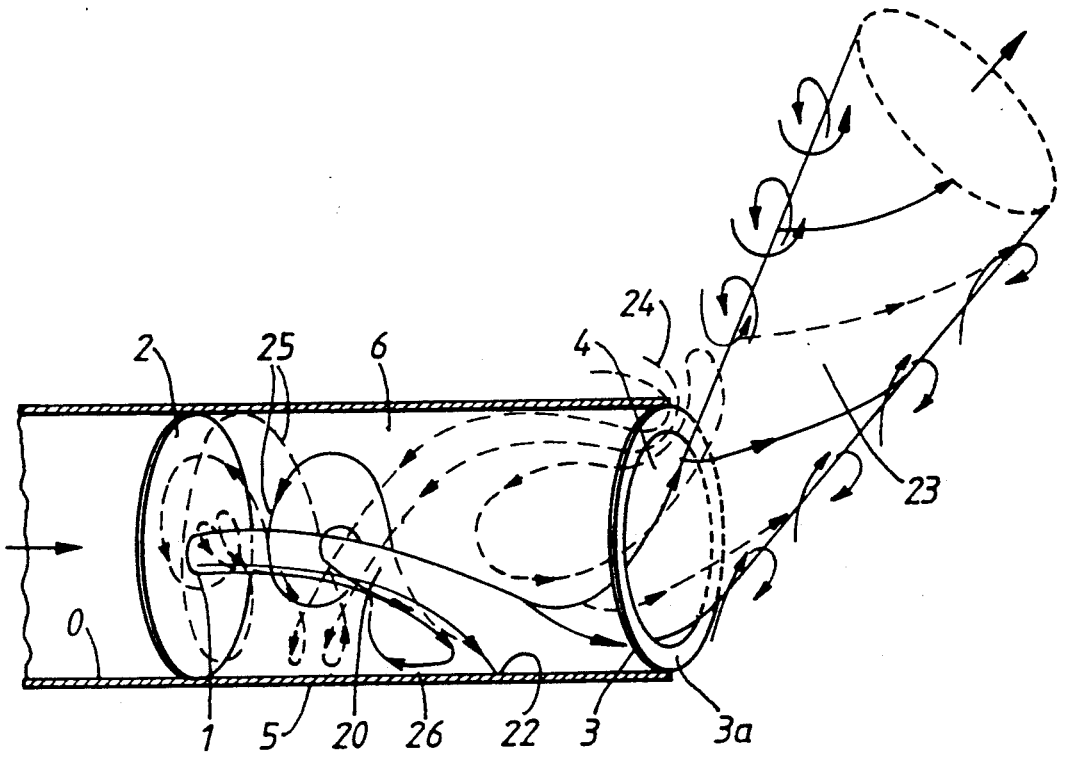
FIG. 6 is a purely schematic sectional flow diagram depicting a perspective view of the instantaneous pattern of the three-dimensional dynamically precessing and swirling flow through to exist in and around an inventive nozzle once enhanced mixing has become established.
Figure 7:
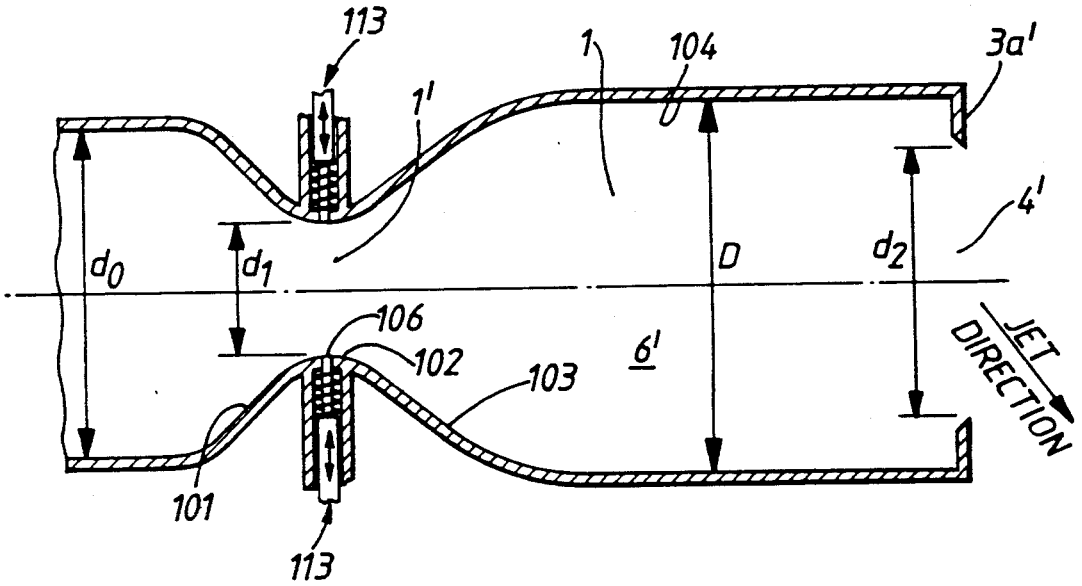
FIG. 7 illustrates one embodiment of the jet vectoring application of the device.

The interpretation of the sequence of flow events which give rise to the jet deflection and rapid precession, illustrated in FIG. 6, is supported by the further result illustrated in FIG. 7. The upstream or inlet section 1′ is now comprised of a contracting section 101, a throat or minimum flow cross-section 102, and a smooth transition into a divergent section 103, as in a Laval nozzle. The expansion rate in the divergent section 103 is such as to cause the flow to separate from one segment of the circumference while remaining attached to the surface elsewhere.

In such circumstances there is no reattachment of the separated jet and hence there is no part of the flow equivalent to stream 26 of FIG. 6. Further, there is no path along which fluid may move in an azimuthal or helical direction around the primary jet. There is thus no mechanism by which swirling of the reversed flow and the resulting precession of the main jet can occur. The jet therefore remains attached predominantly over one segment of the wall (104) of chamber 6′. The azimuthal location of this segment can be determined positively by placing a small protuberance (106) at a point on the surface of the throat 102 of the convergent-divergent inlet 1′ of the nozzle. The attachment then occurs on the wall of the chamber opposite from the position of the protuberance 106. The attached flow mixes strongly with the return flow induced into the chamber from the external field through outlet 4′, so producing a pressure gradient across the section of the chamber. This, together with the upsetting influence of the lip 3*a*′ at the exit plane, causes the jet to leave the nozzle at a sharp angle in a direction opposite from the side of the chamber on which the flow had been attached. The relative peripheral location of the protuberance 106 can be changed by many means. For example the whole nozzle could be rotated about its major axis. Alternatively a set of pins 113, or holes through which small fluid jets could be caused to flow, could be arranged around the periphery at the throat. By means of some simple manual, mechanical or electrical actuation any one pin could be caused to protrude, or any one jet could be emitted, into the flow to form a protuberance or local aerodynamic blockage 106 and so determine the direction at which the jet exits the nozzle through outlet 4'. As a result, the embodiment illustrated in FIG. 7 can be employed as a vectored thrust nozzle.

Figure 4A:
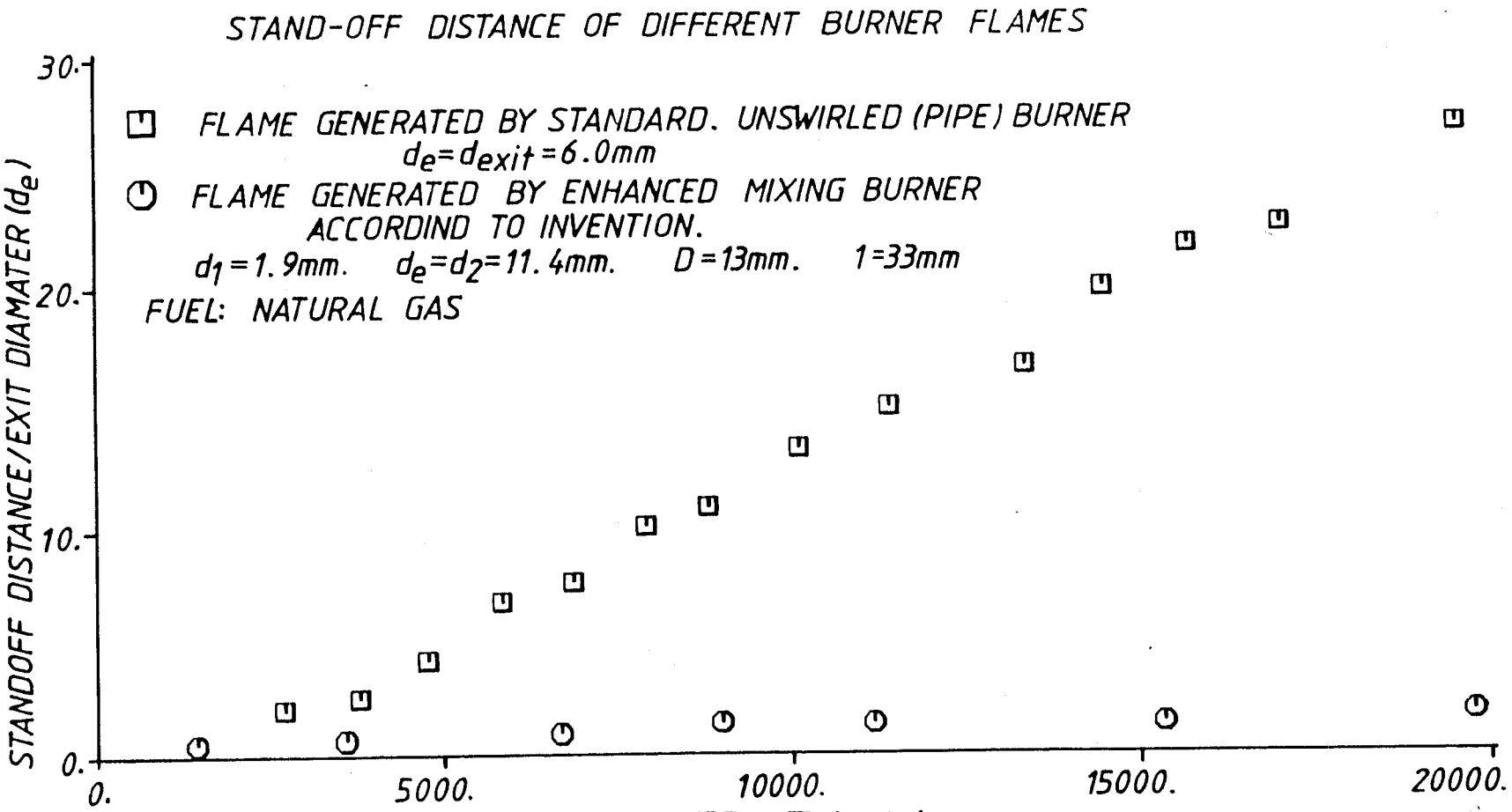
FIG. 4 depicts the measured ratio of stand-off distance of the flame to exit diameter as a function of Reynolds Number [FIG. 4(A)] and as a function of the average velocity through the exit plane [FIG. 4(B)], for a standard, unswirled burner nozzle compared with that for a burner nozzle according to the invention.
Figure 4B:
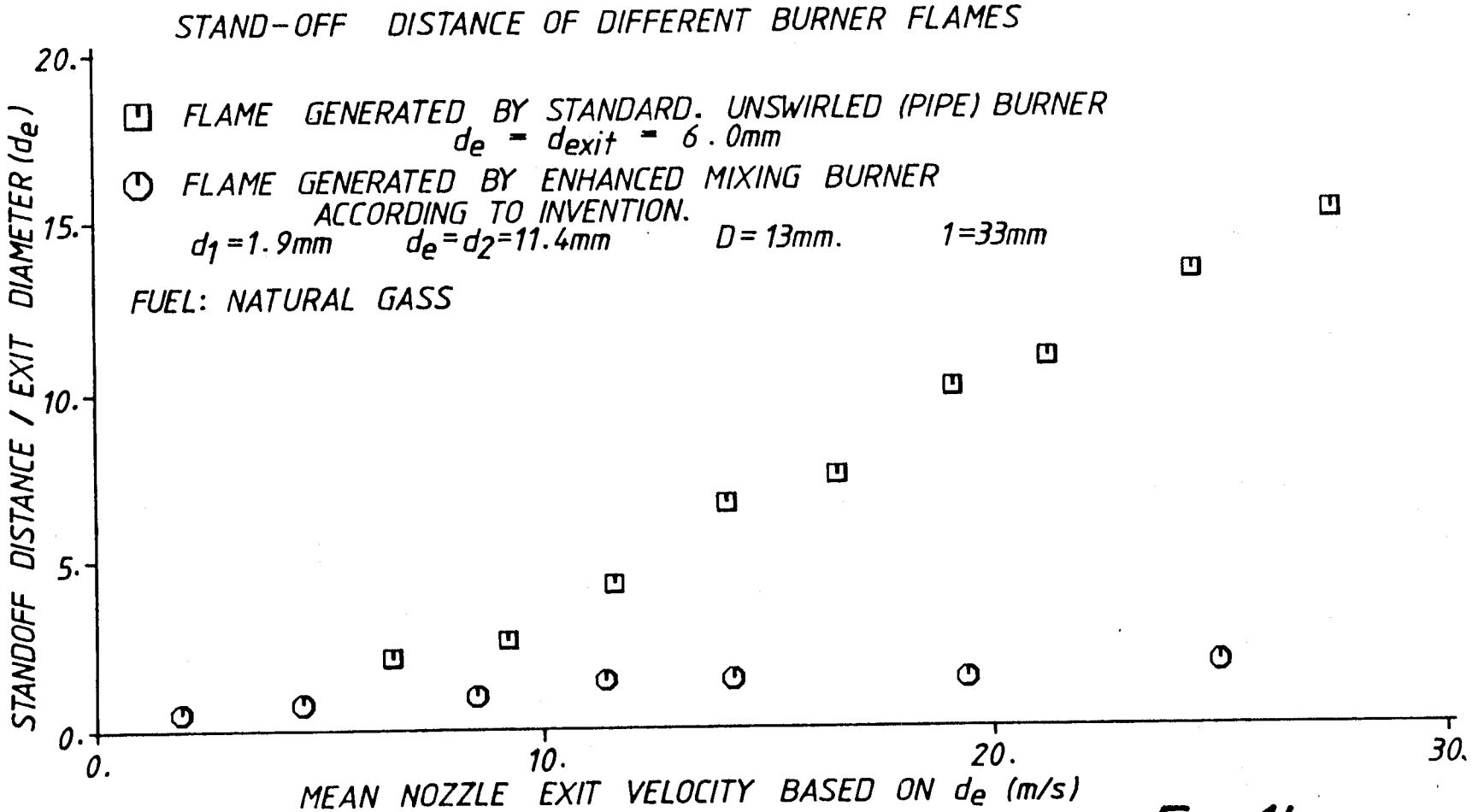

An indication of the effectiveness of a mixing burner nozzle, in which the exiting flow precesses according to the invention, in improving flame stability may be obtained by examining FIG. 4, in which is plotted the stand-off distance of a natural gas flame against the Reynolds Number and against the mean nozzle exit velocity. The stand-off distance is the distance between the nozzle exit plane and the flame front and is a measure of the rate at which the fuel and oxidant are mixed relative to the rate at which they are advected. In simple terms this means that, for a given rate of mixing, the higher the jet exit velocity (which is proportional to the advection velocity) the further the flame will stand off from the nozzle. Similarly, for a given jet exit velocity, the greater the mixing rate the shorter will be the stand-off distance. From FIG. 4 it can be seen that the stand-off distance for the enhanced mixing burner is extremely small indicating that the rate of mixing is very high.

A jet of fluid from a nozzle into otherwise stationary surroundings decreased in velocity as it moves downstream. As the fluid in the jet entrains, or mixes with, the surrounding fluid it must accelerate it from rest up to the mixture velocity. To achieve this the jet must sacrifice some of its momentum and hence must decrease in velocity. Associated with the decrease in velocity is an increase in the jet cross-section; that is, the jet spreads. Hence the rate of decrease in jet velocity is a measure of the spreading rate, or of the rate of mixing of the jet with its surroundings. Thus, a simple comparison of the mixing rates for different nozzle configurations may be obtained by locating a velocity sensor on the jet centre-line at a fixed geometric position relative to the jet exit plane.

Figure 3:
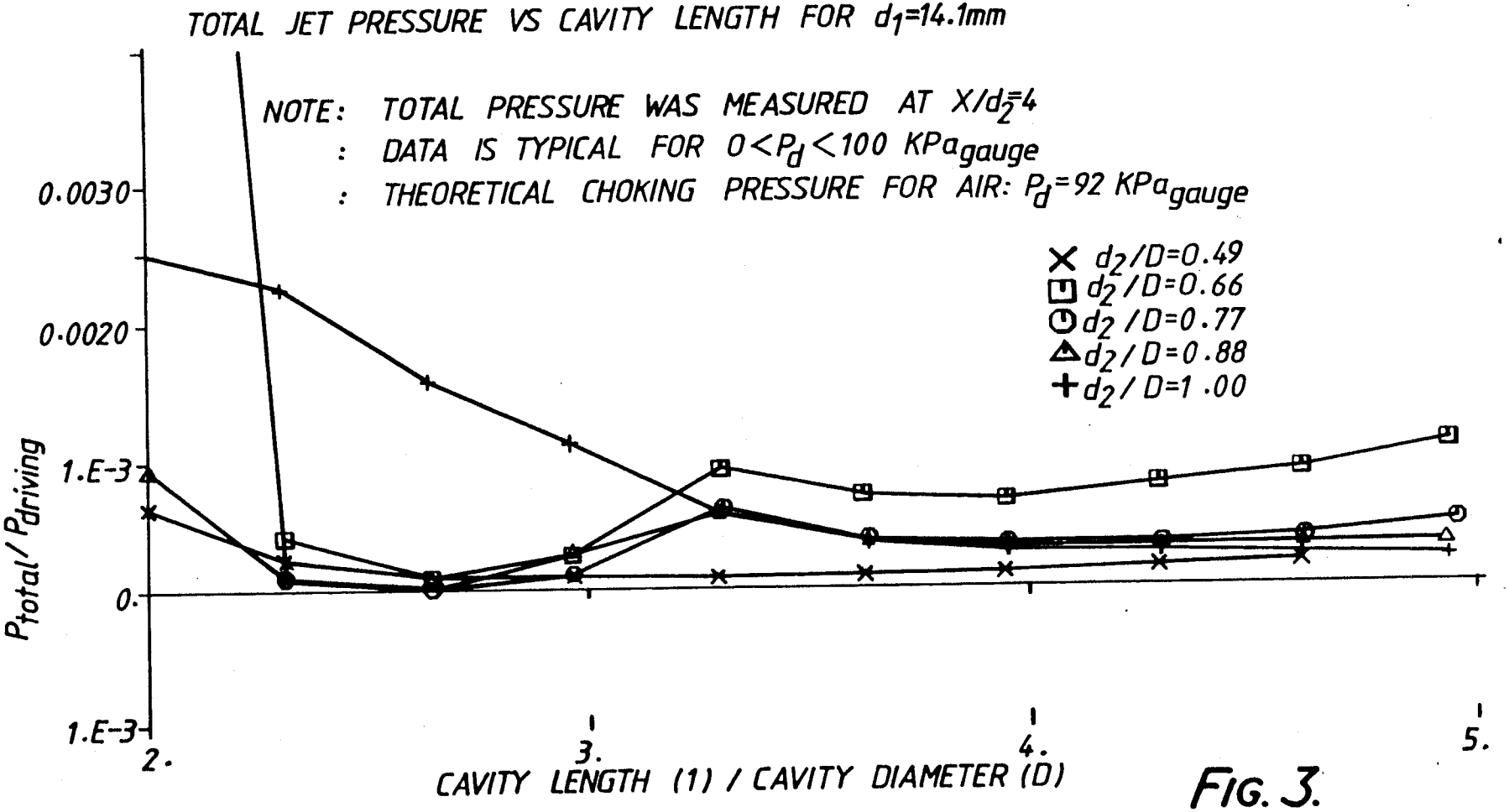
FIG. 3 depicts the measured total pressure (static pressure plus dynamic pressure) on the jet centerline at a location two exit diameters downstream from the nozzle exit, for a particular nozzle, as a function of the length of the chamber. Note that a low value of total pressure indicates a low flow velocity.

The results of such an experiment are shown in FIG. 3 in which the time averaged total pressure in the jet at a position two nozzle exit diameters downstream from the exit plane is plotted as a function of the length of the chamber within a particular enhanced mixing nozzle according to the invention for a range of driving pressures, that is, for a range of flow rates. If the static pressure is constant, the total pressure is proportional to the square of the velocity of the jet at the measuring point. It can be seen from FIG. 3 that for a chamber length of 240 mm, equivalent to $l/D=2.64$, the measured total pressure is approximately zero for all flow rates indicating a very low jet velocity just two nozzle exit diameters away from the nozzle exit. This in turn indicates a very rapid diffusion of the jet and an enhancement of the mixing with its surroundings. (In more detail, the curvature of the mean streamlines in the jet, associated with the extremely rapid spreading rate, causes the static pressure on the centre-line close to the nozzle exit to be initially below ambient but to return to ambient within a distance of two nozzle diameters from the exit plane. Thus zero total pressure very close to the nozzle exit plane does not necessarily means that the velocity is zero. Nevertheless, it is very small.).

When operating the nozzle as a burner to mix the fuel and an oxidant which is in a co-flowing annular stream, which may be swirling, according to the embodiments of FIGS. 2(*a*) and 2(*b*), or which may be otherwise directed, it is advantageous to use a quarl, as illustrated in FIG. 2(*a*), or a combination of a quarl and a combustion tile, as illustrated in FIG. 2(*b*). Such arrangements stimulate very fine scale mixing between the reactants to supplement the large scale mixing associated with the precession. By these means stable flames can be achieved at all mixture ratios from very rich to extremely lean.

All results obtained to date indicate that the same flow phenomenon occurs for all flow rates, thus overcoming the problem of limited turn down ratio which occurred when using the "whistling" nozzle.

In summary, the results indicate that a mixing nozzle according to the present invention greatly enhances the rate of entrainment of the surrounding fluid by the jet exiting the nozzle, causing very rapid spreading of the jet. Consequently, when used as a burner nozzle, the mixture strength necessary to support a flame is established much closer to the nozzle than would be the case with a comparable flow rate from a standard burner nozzle. The large spreading angles are associated with a very rapid decrease in the jet velocity which allows the flame front to be located very close to the nozzle exit where the scale of turbulence fluctuations is small, giving rise to a very stable flame. This is especially important when burning fuels with a low flame speed, such as natural gas, and fuels with a low calorific value.

A combustion/burner nozzle according to the present invention offers the following advantages:

(i) It is stable over the full operating range from "pilot" flows, with driving pressures of a fraction of one kilopascal, through to effectively choked flow (that is, e.g., at a driving pressure for natural gas or LPG of approximately 150 kPa relative to atmosphere; at 180 kPa the flow is certainly fully choked). This driving pressure is to be compared with normal domestic gas pressure of approximately 1.2 to 1.4 kPa; industrial mains pressure of approximately 15 to 50 kPa; and "special users" pressures ranging from 70 to 350 kPa approximately.

(ii) The nozzle can be "overblown". Tests up to 800 kPa (gauge pressure) have failed to blow the flame off the burner.

(iii) With the quarl and tile arrangement of FIG. 2(*b*) and gas supply pressures of 2.5 kPa or greater, it has not been possible to blow the flame off the nozzle within the capacity of the air supply available in the experimental apparatus. The peak air flow available is equivalent to above 1000 percent more air than is required for stoichiometric combustion.

(iv) The operating noise is lower than that of the "whistling" nozzle and contains no dominant discrete tones. Relative to a conventional nozzle operating stably at the same mass flow rate, the noise level is at least comparable.

(v) The fuel can be simply ignited at any point over the whole operating range.

(vi) The flame is not extinguished by creating a large disturbance at the burner exit—for example, by cross flows or by waving a paddle at the flame or through the flame.

(vii) The operation is tolerant of relatively large variations (approximately $\pm 10\%$ in the dimensions l and $d_2$ for a given $d_1$ and D). Hence durability may be anticipated to be good.

Although superficially resembling the "whistling" nozzle disclosed in patent application No. 88999/82, the described embodiments of the invention have a very different detailed geometry and achieve the mixing enhancement by a completely different physical process. No acoustic excitation of the flow, either forced or naturally occurring, is involved. This fact is demonstrated by detailed acoustic spectra and by the following result. For a given embodiment of mixing nozzle according to the present invention, the mixing rate achieved when a jet of water emerges from the nozzle into a stationary body of water is substantially the same as when a jet of air or gas emerges from the nozzle, at the same Reynolds number, into stationary air. If the mixing depended on an acoustic phenomenon this result could not have been obtained as the differences in the material properties of water and air cause the Mach numbers in the two flows to differ by a factor of approximately seventy.

The spectrum of the noise produced by an inert jet of gas emerging from a mixing nozzle according to the invention displays no dominant discrete frequencies, nor do any dominant discrete frequencies appear when the jet is ignited. The noise radiated from a jet emerging from a mixing nozzle according to the invention is less than or comparable with that radiated from a conventional jet of the same mass flow rate and is very substantially less than that from a "whistling" nozzle according to patent application No. 88999/82.

The resonant cavity of the prior "whistling" nozzle is formed by positioning two orifice plates in the nozzle. The enhanced mixing flow patterns observed in and from said prior whistle burner are produced as a result of the cavity between the two orifice plates being caused to resonate in one or more of its natural acoustic modes. These are excited by strong toroidal vortices being shed periodically from the upstream inlet orifice plate. These vortices, through interaction with the restriction at the exit plane, drive the major radial acoustic (0,1) mode in the cavity. While not being sufficient by itself to cause significant mixing enhancement, this (0,1) mode may couple into one or more of the resonant modes of the cavity, such as the organpipe mode. The resonant mode or resonant modes in turn drive an intense toroidal vortex, or system of toroidal vortices, close to and downstream from the nozzle outlet. The ratio of the length of the cavity of the "whistling" nozzle to its diameter is less than 2.0 and is critically dependent on the operating jet velocity. A typical ratio is 0.6.

The acoustic resonance of the cavity of the "whistling" nozzle is driven by vortices which are shed at the Strouhal shedding frequency from the upstream orifice. This frequency must match the resonant frequency of one or more of the acoustic modes of the cavity for the mixing enhancement to occur in the resulting jet. The ability of the Strouhal vortices to excite the resonant modes of the cavity depends on their strength, which in turn depends on the velocity at their point of formation. Since the Strouhal shedding frequency also is dependent on velocity, there is a minimum flow rate at which the resonance will "cut-on". The pressure drop across an orifice plate increases with the square of the velocity, and hence achievement of the minimum, or "cut-on", flow rate requires a high driving pressure.

The present enhanced mixing jet nozzle differs from the "whistling" nozzle in that it does not depend on any disturbance coupling with any of the acoustic modes of a chamber or cavity. Further, it does not require the shedding of strong vortices into the chamber from the inlet and the minimum flow rate at which enhancement occurs is not determined by the "cut-on" of any resonance.

INDUSTRIAL APPLICATIONS

A nozzle according to the present invention is expected to be well adapted to use in the following combustion applications:

GASEOUS FUEL (i) Conversion of oil fired furnaces to natural gas. Natural gas has about ⅓ of the calorific value of oil. Accordingly, to maintain the rating of the furnace, 3 times the mass flow of gas relative to oil is needed. In volume terms the increase is around 2000 times. With conventional burners this results in very long gas flames which can burn out the back end of the furnace, or can operate unstably due to flame front oscillation which can lead to intermittent flame-out or can excite one or more system resonances. Both results force either a de-rating of the furnace or a major rebuild of the firing end of the furnace. The shape of the flame from the new burner is relatively short and bulbous or ball-like.

(ii) Combustion of low calorific value "waste" gases, as from chemical process plants or blast furnaces, or from carbon black or smokeless fuel manufacture, should be possible.

(iii) Correction of unstable operation of gas fired boilers in industry or in power stations can be effected. Such instability is very common and is frequently called "intrinsic" by combustion engineers. Many of the gas fired boilers in power stations suffer from the problem. The present inventors suggest that the instability is not wholly intrinsic but is due primarily to poor mixing which aggravates the effect of a low flow spread in the gas/air mixture.

(iv) Domestic and industrial water heaters. Safety is determined by the possibility that the flame will go out without this being detected due to failure of the flame detection system. With the present invention, the probability of the flame being unexpectedly extinguished is reduced.

(v) Industrial gas turbine combustors. Many applications for gas turbines in marine propulsion systems, in industrial process plants, or as a topping cycle for power generating steam plant, are emerging and many installations exist. The burning of gas in low quality gas turbine combustors can lead to serious problems. The present invention should reduce these problems.

(vi) One source of large quantity of gasification of coal. Such gas could be used in gas turbines using the present invention or as a boiler fuel. The development of new generation coal gasification plants, for example Uhde-Rheinbraun, Sumitomo, Westinghouse, etc., which produce relatively low calorific value gas, will extend applications. Such plants are usually followed by a stage in which the gas is reconstituted to become a synthetic natural gas (SNG). This is an expensive process and, if by-passed, leaves the problem of burning a low calorific value, low flame speed, variable quality gas stably. To do this by conventional means requires very large combustion chambers, complex igniter and pilot flame systems and possibly the addition of some high quality gas at times when the coal gas quality is low. Flame stability can be greatly increased and combustion space can be greatly reduced with the present invention.

LIQUID FUEL (i) The present nozzle should improve the performance of oil fired plant, especially if air-blast atomisation is used.

(ii) If successful with liquid fuels, the applications would embrace those listed for gaseous fuel but to these would be added:

Aircraft gas turbines (especially if the ability to light the flame at full fuel flow, found with gas, can be repeated with a liquid fuel).

Automotive fuel injection system—especially the air-blast system as developed and patented by the Orbital Engine Co.

SOLID (PULVERISED) FUELS (i) Preliminary investigations for pulverised fuel have indicated that the chamber within the nozzle is self-cleaning and will not clog with fuel.

(ii) The ability of a burner with the present nozzle to operate at low flow rates, and the fact that it does not rely on a recirculating zone at the nozzle exit, suggest that successful pulverised fuel firing may be possible with the new design. Embodiments such as that shown in FIG. 1(*e*) with the pulverised fuel admitted via the body (7), or in FIG. 2(*a*), with the pulverised fuel introduced with Flow 1, show promise. If successful, the range of applications of the burner would expand to include fired boilers of all types from power stations to industrial boilers, including those in the metals industry.

(iii) A possible side benefit may be that sulphurous coals may be able to be fired by blending the pulverised fuel with dolomite. The reason for this being a possibility is that some control over combustion temperature should be available by establishing the appropriate relationship between primary air quantity and temperature and the mixing rate with the secondary air.

An enhanced mixing nozzle according to the present invention, if it is considered as a simple nozzle which produces intense mixing in addition to the combustion applications discussed above, could be adapted to the following non-combustion applications:

(a) Ejectors—which are used either to produce a small pressure rise from $p_1$ to $p_2$ (as in a steam "eductor'-'—for which there would be many applications in the process industry if $p_2/p_1$ could be increased for a given high pressure steam consumption by the nozzle) or to produce a reduced pressure $p_1$ (for example, the laboratory jet vacuum pump on a tap) or to induce a mass flow through the system. One embodiment of this is the swimming pool "vacuum cleaner" but another more important one is the rocket assisted ram-jet in which a small solid, liquid or gaeous fuel rocket produces a high temperature, high pressure jet which entrains the surrounding air and so induces a greater mass flow through the system than would occur simply through forward flight. Such a system is also self-starting in that the vehicle does not have to reach some minimum speed before the ram jet effect begins to operate—that is, there is no need for a secondary power unit.

(b) Aircraft jet engine exhaust nozzles. The momentum flux through the exit plane of the exhaust nozzle determines the nozzle thrust. This is not affected by the rate of spread of the jet (mixing rate) downstream of the exit plane. By inducing a high mixing rate, jet noise can be reduced significantly.

(c) Take-off and landing distance of aircraft can be reduced by directing the propelling jet, or an ancillary jet, wholly or partially downwards. The embodiment of the present invention illustrated in FIG. 7 provides a means by which the jet direction can be adjusted without the use of mechanically operated flaps, vanes or tabs being inserted into the high temperature jet exhaust.

(d) The rate at which an aircraft can change direction in flight can be increased greatly by changing the vector direction of the propelling jet relative to the aircraft. The embodiment of the present invention illustrated in FIG. 7 provides such means by which the jet direction can be altered quickly and without significant weight penalty.

(e) The lift of an aircraft can be increased substantially by designing the aircraft so that the propelling jet can be directed at an angle close to the upper surface of the wing. The embodiment illustrated in FIG. 7 provides a means of achieving such a deflection of the jet.

(f) Hovering rockets have been proposed for use by shipping as missile decoys. Such rockets require the supporting jet to be deflected quickly from one direction to another to maintain stability. The embodiment illustrated in FIG. 7 provides a means by which the primary or one or more secondary jets could be so deflected.

(g) Space vehicles, in the absence of gravity and of aerodynamic lift and drag forces, must rely on reaction forces to maintain position and altitude. This is typically achieved by means of small jets which may be orientated to point in the direction opposite from that in which motion of the vehicle is required. The vectored thrust embodiment illustrated in FIG. 7 could provide a simple and more reliable means of achieving the desired reaction direction.

(h) The accuracy and range of shells fired from large guns can be increased by igniting a small rocket motor on the base of the shell. Reliability of ignition is critical in such an application and hence the applicability of the present invention.

(i) Expresso coffee machines—the steam jet can foam the coffee/cream without as much chance of splash.

(j) Basic Oxygen conversion of iron to steel. The actual immersion of the oxygen lance (for example, if made of ceramic) may be possible rather than having to rely on penetration of the surface of the melt by a very high velocity oxygen jet, thus resulting in a reduced consumption of oxygen.

We claim:

1. A fluid mixing device comprising:

wall structure defining a chamber having a fluid inlet and a fluid outlet disposed generally opposite the inlet;

said chamber being larger in cross-section than said inlet at least for a portion of the space between said inlet and outlet;

flow separation means to cause a flow of a first fluid wholly occupying said inlet to separate from said wall structure upstream of the outlet;

wherein the distance between said flow separation means and said outlet is sufficiently long in relation to the width of the chamber for the separated flow to reattach itself asymmetrically to the chamber wall structure upstream of the outlet and to exit the chamber through the outlet asymmetrically, whereby a reverse flow of said first fluid at said reattachment and a flow of a second fluid induced from the exterior of the chamber through said outlet swirls in the chamber between said flow separation and said reattachment and thereby induces precession of said separated/reattached flow, which precession enhances mixing of the flow with said second fluid to the exterior of the chamber.

2. A fluid mixing device according to claim 1 wherein said wall structure, chamber, inlet, outlet and flow separation means are axially symmetrical.

3. A fluid mixing device according to claim 1, wherein said fluid outlet is larger than the chamber cross-section at the separation of the flow.

4. A fluid mixing device according to claim 1, further comprising a peripheral restriction at said fluid outlet to induce or augment a transverse component of velocity in the reattached precessing flow.

5. A fluid mixing device according to claim 1, wherein said fluid inlet is a continguous single opening which does not divide up the first fluid as it enters the chamber.

6. A fluid mixing device according to claim 1, further comprising means to reduce intermittency in said mixing.

7. A fluid mixing device according to claim 6, wherein said means to reduce intermittency comprises a body disposed within said chamber.

8. A fluid mixing device according to claim 1, wherein the ratio of the distance between said flow separation means and said outlet to the diameter of the chamber at the reattachment locus is greater than 1.8.

9. A fluid mixing device according to claim 8, wherein said ratio is about 2.7.

10. A fluid mixing device according to claim 1, wherein said flow separation means is provided by an inlet quarl divergent from said fluid inlet into said chamber.

11. A method of mixing two fluids, comprising deflecting or allowing deflection of a flow of one of the fluids through an acute angle within a chamber and causing the deflected flow to precess, which precession enhances mixing of the flow with the other of the fluids from the exterior of the chamber.

12. A method according to claim 11 wherein said deflected flow is also caused to diverge.

13. A method of mixing first and second fluids, comprising:

admitting the first fluid into a chamber as a flow which separates from the chamber wall structure; and allowing the separated flow to reattach itself asymmetrically to the chamber wall structure upstream of an outlet of the chamber disposed generally opposite the admitted flow, and to exit the chamber through the outlet asymmetrically;

whereby a reverse flow of the first fluid at said reattachment and a flow of the second fluid induced from the exterior of the chamber through said outlet combine to swirl in the chamber between said flow separation and said reattachment and thereby induce precession of said separated/reattached flow, which precession enhances mixing of this flow with the second fluid to the exterior of the chamber.

14. A method according to claim 13 wherein said flow is divergent as it exits the chamber through the outlet.

15. A method according to claim 13, further comprising obstructing said flow at the outlet to induce or augment a transverse component of velocity in the reattached precessing flow.

16. A fluid flow control device, comprising:

wall structure defining a chamber having a fluid inlet and a fluid outlet disposed generally opposite the inlet;

said chamber being larger in cross-section than said inlet at least for a portion of the space between said inlet and outlet;

flow separation means to cause a flow of a first fluid wholly occupying said inlet to partially separate from said wall structure upstream of the outlet;

wherein the distance between the flow separation means and said outlet is sufficiently long in relation to the width of the chamber for the partially separated flow to induce a second flow from the exterior of the chamber through said outlet and for this second flow to influence the partially separated flow whereby the latter exits the chamber asymmetrically in a direction toward the same side of the chamber as the flow separation.

17. A fluid flow control device according to claim 16 wherein said outlet includes a peripheral restriction to act on the flow and enhance its asymmetric direction from the outlet.

18. A fluid flow control device according to claim 16, wherein said inlet is a smoothly convergent-divergent restriction fitted with a protuberance or other disturbance, at one side at or near its minimum cross-section, to cause said partial separation.

19. A fluid flow control device according to claim 18, wherein said protuberance is withdrawable to permit control of the direction of the exiting flow.

20. A fluid flow control device according to claim 18, wherein said protuberance comprises multiple elements individually provided with means to retractably project them into the interior of the restriction at different azimuthal or circumferential locations.

21. Combustion apparatus having a combustion nozzle with a fluid mixing device comprising:

wall structure defining a chamber having a fluid inlet and a fluid outlet disposed generally opposite the inlet;

said chamber being larger in cross-section than said inlet at least for a portion of the space between said inlet and outlet;

flow separation means to cause a flow of a first fluid wholly occupying said inlet to separate from said wall structure upstream of the outlet;

wherein the distance between said flow separation means and said outlet is sufficiently long in relation to the width of the chamber for the separated flow to reattach itself asymmetrically to the chamber wall structure upstream of the outlet and to exit the chamber through the outlet asymmetrically, whereby a reverse flow of said first fluid at said reattachment and a flow of a second fluid induced from the exterior of the chamber through said outlet swirls in the chamber between said flow separation and said reattachment and thereby induces precession of said separated/reattached flow, which precession enhances mixing of the flow with said second fluid to the exterior of the chamber.

* * * * *